US006971186B1

(12) United States Patent
Chin et al.

(10) Patent No.: US 6,971,186 B1
(45) Date of Patent: Dec. 6, 2005

(54) LINT FILTER ASSEMBLY FOR USE IN A DRYER

(76) Inventors: TJ Chin, 1164 E. 43rd St., Brooklyn, NY (US) 11210; Patricia Farrow, 1164 E. 43rd St., Brooklyn, NY (US) 11210

( * ) Notice: Subject to any disclaimer, the term of this patent is extended or adjusted under 35 U.S.C. 154(b) by 0 days.

(21) Appl. No.: 10/776,816

(22) Filed: Feb. 11, 2004

(51) Int. Cl.[7] ..... F26B 21/06
(52) U.S. Cl. ..... 34/82; 34/140; 34/544
(58) Field of Search ..... 34/140, 82, 79, 34/544, 552

(56) References Cited

U.S. PATENT DOCUMENTS 3,639,998 A * 2/1972 Mason ..... 34/82
5,097,606 A 3/1992 Harmelink et al. ..... 34/32
5,157,848 A * 10/1992 Dongelmans ..... 34/82
5,281,956 A * 1/1994 Bashark ..... 340/660
5,518,025 A * 5/1996 Futa et al. ..... 137/468
5,709,040 A 1/1998 Horwitz ..... 34/565
5,850,183 A * 12/1998 Berry, III ..... 340/607
5,860,224 A 1/1999 Larson ..... 34/418
6,725,732 B1 * 4/2004 Stein ..... 73/861.55
6,785,981 B1 * 9/2004 Harpenau ..... 34/140

* cited by examiner

*Primary Examiner*—Denise L. Esquivel
*Assistant Examiner*—Kathryn S. O'Malley
(74) *Attorney, Agent, or Firm*—Goldstein Law Offices, P.C.

(57) ABSTRACT

A filter assembly for collecting lint in use with a dryer having an interior compartment. The filter assembly includes a control unit, an input air pathway in communication with the interior compartment, an exhaust, and a micro-filter. The input air pathway carries air and lint from the interior compartment through the micro-filter into the exhaust. The filter assembly includes a first and second air flow sensor in the interior compartment for determining the change of air flow between the input air pathway and exhaust. The control unit is in communication with the first and second air flow sensors and an alarm. The control unit triggers the alarm when the air flow sensors detect a restricted pattern of air flow, thereby signaling a build-up of lint in the filter.

2 Claims, 2 Drawing Sheets

LINT FILTER ASSEMBLY FOR USE IN A DRYER

BACKGROUND OF THE INVENTION

The invention relates to a clothing dryer, and more particularly, to a filter assembly for a dryer which collects lint and notifies operators when it needs to be cleaned.

Everyone who has washed laundry is familiar with a lint filter. The lint filter must be cleaned frequently to allow the dryer to dry the clothes as efficiently as possible. In addition, clothes in the dryer are not lint free unless the filter is cleaned often. Most of the time, however, lint filters are not cleaned out until they are completely filled with lint.

U.S. Pat. No. 5,860,224 to Larson discloses an instrument that is placed in the position of the lint filter for allowing a service person to determine if an exhaust vent is blocked. U.S. Pat. No. 5,097,606 to Harmelink discloses a clothing dryer with means to signal the user to check the filter if it has not been cleaned in the last cycle. U.S. Pat. No. 5,709,040 to Horowitz discloses a clothing dryer with an exhaust air sensing device capable of counting particles.

While these units may be suitable for the particular purpose employed, or for general use, they would not be as suitable for the purposes of the present invention as disclosed hereafter.

SUMMARY OF THE INVENTION

It is an object of the invention to produce a dryer filter that takes the guesswork out of knowing when the filter needs to be cleaned. Accordingly, the invention is a filter for use in a dryer, having a control panel in communication with an alarm and a first and second air flow sensor for detecting a reduction in air flow through the filter, and then signaling the alarm.

It is another object of the invention to provide a dryer filter, which costs less to operate and helps to keep clothes lint free. Accordingly, the present invention allows operators to know exactly when the filter needs to be cleaned, allowing the dryer to operate at optimum efficiency, and thereby costing less to operate while removing more lint from the clothing.

The invention is a filter assembly for collecting lint in use with a dryer having an interior compartment. The filter assembly includes a control unit, an input air pathway in communication with the interior compartment, an exhaust, and a micro-filter. The input air pathway carries air and lint from the interior compartment through the micro-filter into the exhaust. The filter assembly includes a first and second air flow sensor in the interior compartment for determining the change of air flow between the input air pathway and exhaust. The control unit is in communication with the first and second air flow sensors and an alarm. The control unit triggers the alarm when the air flow sensors detect a restricted pattern of air flow, thereby signaling a build-up of lint in the filter.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
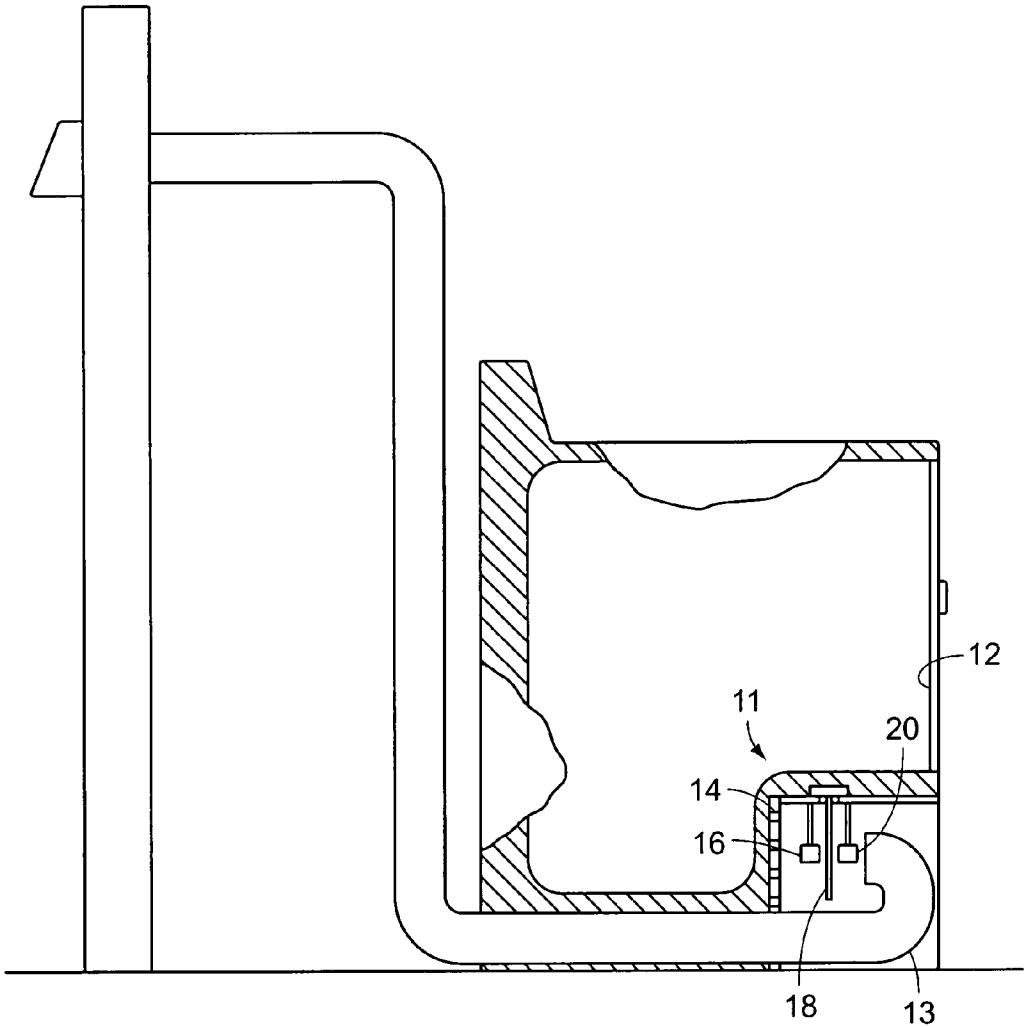
FIG. 1 is a front elevational view of a dryer with the filter assembly of the present invention having a micro-filter for collecting lint and a first and second air flow sensor for detecting air flow through the micro-filter.

FIG. 1 illustrates a dryer 10, having an interior compartment 12, an exhaust 13, and a filter assembly 11. The interior compartment 12 is the portion of the dryer 10 where clothes are contained while drying. The filter assembly 11 has an input air pathway 14 for carrying air and lint from the interior compartment 12 into the filter assembly 11. The input air pathway 14 is generally a plurality of openings adjacent the interior compartment 12. A first air flow sensor 16 is located within the input air pathway 14 and is used to determine an intake pattern of air flow. Air and lint travel from the interior compartment 12 of the dryer 10 through the input air pathway 14, through a micro-filter 18, and into the exhaust 13. The micro-filter 18 catches the lint and holds the lint therein until an operator is able to clean it out. An operator cleans out the lint by hand, by removing the micro-filter 18 from the interior compartment 12, and gathering and disposing of the lint thereon.

A second air flow sensor 20 is located adjacent to the micro-filter 18, and adjacent to the exhaust 13. The second air flow sensor 20 is used to determine the air flow after traveling through the micro-filter 18 and is used to detect any change in the air flow between the first air flow sensor 16 in the input air pathway 14, and itself at the exhaust 13. When the interior compartment 12 and micro-filter 18 fill with lint, the flow of air through the micro-filter and out the exhaust 13 will decrease from the flow detected in the input air pathway 14 just prior to entering the interior compartment 12. The second air flow sensor 20 is used to make this determination of decreased air flow, thereby signaling an increase in lint in the interior compartment 12.

Figure 2:
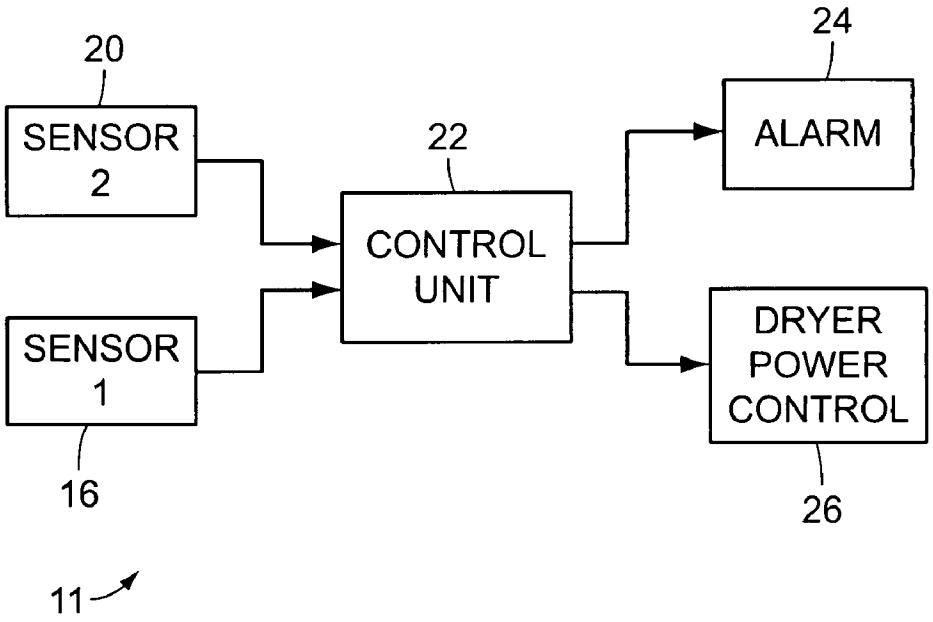
FIG. 2 is a block diagram of the filter, having a control unit in communication with the first and second air flow sensors for triggering an alarm and a power control unit when air flow is substantially reduced.

FIG. 2 illustrates a block diagram of the filter assembly 11 of the dryer 10, including the first and second air flow sensors 16 and 20, which are used to detect the air flow from the input air pathway 14 and into the exhaust 13. The first and second air flow sensors 16 and 20 are in communication with a control unit 22. The control unit 22 is in further communication with an alarm 24 and a power control unit 26. The control unit 22 determines when the first and second air flow sensors 16 and 20 indicate when the air flow detected falls below a predetermined amount, or when the difference in air flow is greater than a predetermined amount. At this time the control unit 22 triggers the alarm 24, which activates an audible and visible signal. The signal is used to notify an operator that the filter assembly 11 is filled with too much lint that the dryer 10 is no longer operating at optimum efficiency, and needs to be cleaned. This allows the operator to clean the filter assembly 11 as often as necessary so that the dryer is always working at its optimum efficiency, thereby saving money and producing enhanced lint free clothing. In addition, the control unit 22 may also trigger the power control unit 26 that can disable the dryer 10 when air flow is severely restricted.

In conclusion, herein is presented a lint filter assembly for use in a dryer. The invention is illustrated by example in the drawing figures, and throughout the written description. It should be understood that numerous variations are possible, while adhering to the inventive concept. Such variations are contemplated as being a part of the present invention.

What is claimed is:

1. A lint filter for use in a clothing dryer, having an interior compartment that holds clothes to be dried, and having an exhaust, comprising:

a micro-filter for collecting lint;

an input air pathway for carrying air flow and lint from the dryer through the micro-filter, the exhaust located adjacent to the micro-filter, fully opposite from the input air pathway;

a first air flow sensor located adjacent to the micro-filter and input air pathway, said first air flow sensor located within the input air pathway for determining the initial pattern of air flow through the input air pathway prior to entering the micro-filter;

a second air flow sensor located adjacent to the micro-filter and adjacent to the exhaust, said second air flow sensor for determining air flow into the exhaust; and a control unit in communication with the first and second air flow sensors for detecting changes in the air flow pattern between the first air flow sensor and the second air flow sensor for determining that the lint filter is restricting air flow therethrough.

2. The filter of claim 1, wherein the control unit is in communication with an alarm, which the control unit triggers when the restricted air flow is determined, thereby signaling a build-up of lint.

* * * * *